US006142131A

United States Patent [19]

Wortman et al.

[11] Patent Number: 6,142,131

[45] Date of Patent: Nov. 7, 2000

[54] ELECTROMAGNETIC LAUNCHER WITH PULSE-SHAPING ARMATURE AND DIVIDED RAILS

[75] Inventors: Donald E. Wortman, Rockville; John D. Bruno, Bowie; Thomas B. Bahder, Silver Spring, all of Md.

[73] Assignee: The United States of America as represented by the Secretary of the Army, Washington, D.C.

[21] Appl. No.: 09/215,503

[22] Filed: Dec. 9, 1998

Related U.S. Application Data

[60] Provisional application No. 60/084,933, May 8, 1998.

[51] Int. Cl.[7] ..... F41B 6/00; F41F 7/00; F41F 1/00

[52] U.S. Cl. ..... 124/3; 89/8

[58] Field of Search ..... 89/8; 124/3; 104/281–286

[56] References Cited

U.S. PATENT DOCUMENTS

| | | | |
|---|---|---|---|
| H1389 | 1/1995 | Weldon et al. | 89/8 |
| 1,370,200 | 3/1921 | Fauchon-Villeplee | 89/8 |
| 3,985,078 | 10/1976 | Hart et al. | 102/70.2 R |
| 4,319,168 | 3/1982 | Kemeny | 318/135 |
| 4,343,223 | 8/1982 | Hawke et al. | 89/8 |
| 4,480,523 | 11/1984 | Young et al. | 89/8 |
| 4,485,720 | 12/1984 | Kemeny | 89/8 |
| 4,718,322 | 1/1988 | Honig et al. | 89/8 |
| 4,754,687 | 7/1988 | Kemeny | 89/8 |
| 4,858,513 | 8/1989 | Kemeny | 89/8 |
| 4,884,489 | 12/1989 | Zowarka et al. | 89/8 |
| 4,913,030 | 4/1990 | Reynolds | 89/8 |
| 4,926,741 | 5/1990 | Zabar | 89/8 |
| 4,928,572 | 5/1990 | Scott et al. | 89/8 |
| 4,934,243 | 6/1990 | Mitcham et al. | 89/8 |
| 4,935,708 | 6/1990 | Weldon et al. | 322/62 |
| 4,986,160 | 1/1991 | Kemeny | 89/8 |
| 4,987,821 | 1/1991 | Kemeny et al. | 89/8 |
| 5,031,503 | 7/1991 | Walsh | 89/8 |
| 5,076,136 | 12/1991 | Aivaliotis et al. | 89/8 |
| 5,078,042 | 1/1992 | Jensen | 89/8 |
| 5,081,901 | 1/1992 | Kemeny et al. | 89/8 |
| 5,090,292 | 2/1992 | Reip et al. | 89/8 |
| 5,127,308 | 7/1992 | Thompson et al. | 89/8 |
| 5,133,241 | 7/1992 | Koyama et al. | 89/8 |
| 5,138,929 | 8/1992 | Weldon et al. | 89/8 |
| 5,155,289 | 10/1992 | Bowles | 89/8 |
| 5,285,763 | 2/1994 | Igenbergs | 124/3 |
| 5,294,850 | 3/1994 | Weh et al. | 310/13 |
| 5,385,078 | 1/1995 | Carey et al. | 89/8 |
| 5,431,083 | 7/1995 | Vassioukevitch | 89/8 |
| 5,483,863 | 1/1996 | Dreizin | 89/8 |

FOREIGN PATENT DOCUMENTS

| | | | |
|---|---|---|---|
| 3-144295A | 6/1991 | Japan | 124/3 |
| 2-81969 | 3/1992 | Japan | 124/3 |
| 2-174395 | 6/1992 | Japan | 124/3 |
| 2-230570 | 8/1992 | Japan | 124/3 |
| 2-255142 | 8/1992 | Japan | 124/3 |
| 3-110453 | 4/1993 | Japan | 124/3 |
| 4-147451 | 3/1994 | Japan | 124/3 |

OTHER PUBLICATIONS

"Electric Guns", National Defense, Terry L. Metzgar, pp. 13–18, Mar. 1991.

"Electromagnetic Gun", Popular Science, Robert Langreth, p. 32, Nov. 1994.

S.B. Pratap et al., "A Study of Operating Modes for Compulsator Based EM Launcher Systems"; *IEEE Transactions on Magnetics*, vol. 33, No. 1, Jan. 1997.

*Primary Examiner*—Peter M. Poon
*Assistant Examiner*—Fredrick T. French, III
*Attorney, Agent, or Firm*—Paul S. Clonan, Jr.; Mark D. Kelly

[57] ABSTRACT

An electromagnetic launcher includes a single or multipolar, multi-phase electrical generator powered by an external source; electrical conductors leading from output coils of the generator and from a center point joining the output coils; a plurality of rails connected to the electrical conductors; and an armature having at least two channels; whereby there is at least one position of the armature along the plurality of rails where current flows simultaneously through both of the at least two channels.

18 Claims, 9 Drawing Sheets

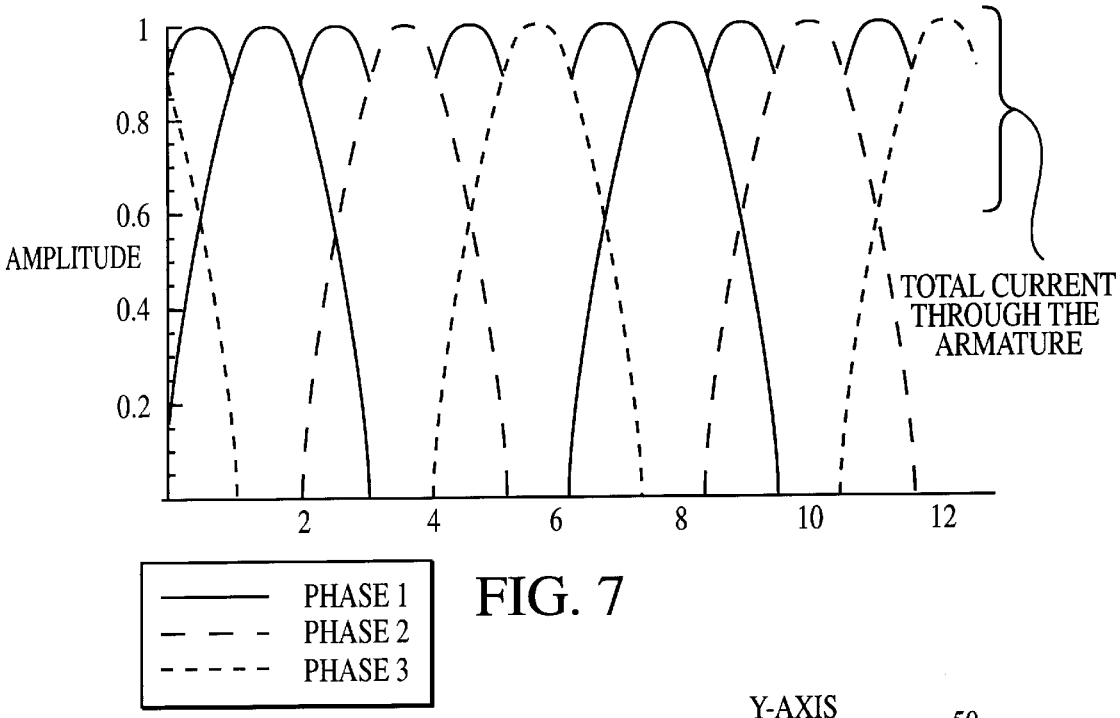
FIG. 7
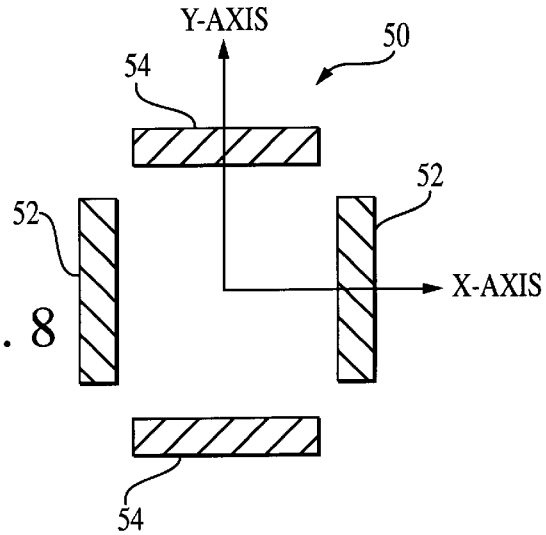
FIG. 8
FIG. 9
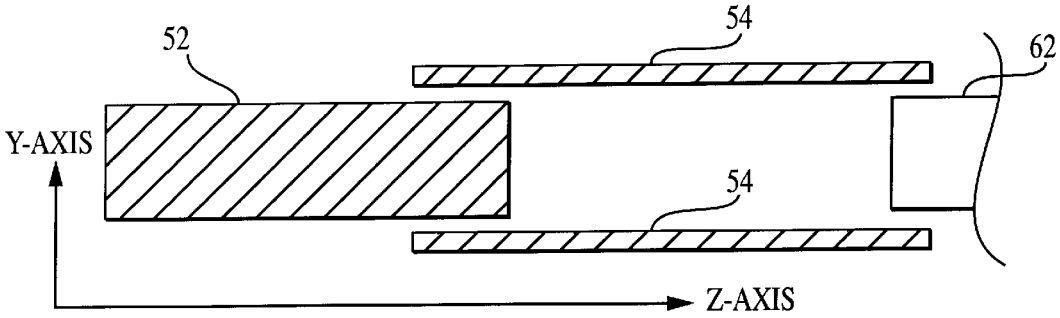

ELECTROMAGNETIC LAUNCHER WITH PULSE-SHAPING ARMATURE AND DIVIDED RAILS

RELATED APPLICATIONS

This application claims the benefit of the filing date of provisional patent application 60/084,933 filed May 8, 1998.

BACKGROUND OF THE INVENTION

The present invention relates generally to electromagnetic rail guns (EMGs), and in particular to controlling and guiding current pulses that are generated in rotating machines such as synchronous generators intended to power electromagnetic rail guns and, thereby, to improve the efficiency and performance of the EMGs.

According to Pratap et al. (S. B. Pratap, J. P. Kajs, W. A. Walls, W. F. Weldon, and J. R. Kitzmiller, "A Study of Operating Modes for Compulsator Based EM Launcher Systems", IEEE Transactions On Magnetics 33 (no. 1), 495 (1997), which is expressly incorporated by reference herein), EMGs built and tested up until 1998 were single phase systems. Several difficulties, including the upper limit on the rotational speed of the rotor, were encountered in cases where multi-megajoule output was required and caused attention to be focused on multi-polar/multi-phase systems.

One such multi-polar/multi-phase system 10 is shown schematically in FIG. 1. The rotating field coil 20, which is driven by external means, is first magnetized by the current that results from the discharge of the capacitor 12. Voltages are induced in the stator coils P1, P2, and P3 due to the changing magnetic flux through them, and when sufficient voltages are generated, a current flows through the field coil 20 ("self excitation" of the field coil) and, when switched, through the load 14 (the two rails of the EMG), all via the rectifying system 16 to accelerate the armature along the rails. Numeral 21 is the field initiation module.

In this three-phase, two rail system, a collection of rectifiers and switches 16 are used to provide relatively smooth acceleration to the projectile. The current through the rails of the multi-phase staged discharge of the EMG of FIG. 1 is shown in FIG. 2. The force on the projectile, applied by the sliding armature, is given by $F=(\frac{1}{2})L'I^2$, wherein L' is the inductive gradient along the rails and I is the current flowing through the armature. Because the force is proportional to $I^2$, alternating current (ac) may be used to accelerate the projectile; however, the unsmooth acceleration, as well as other problems associated with the use of ac, as described in Pratap et al., makes ac undesirable. The acceleration along the rails (as given by Newton's second law) is: $a=F/m$, where a is the acceleration, F is the force, and m is the combined mass of the projectile, armature, and sabot.

BRIEF DESCRIPTION OF THE DRAWINGS

The invention will be better understood, and further objects, features and advantages thereof will become more apparent from the following description of the preferred embodiments, taken in conjunction with the accompanying drawings in which:

FIG. 7 shows the output currents of the EMG of FIG. 4 of each phase as the armature moves from one set of rails to another set and connects different phases for one cycle.

FIG. 8 schematically shows a second embodiment of the invention.

FIG. 9 is a schematic side view of the embodiment of FIG. 8

DESCRIPTION OF PREFERRED EMBODIMENTS

The present invention is a method and apparatus for improving the performance and capabilities of pulse power supplies based on rotating machines intended to power EMGs. By separating the armature (which pushes the sabot and projectile along the EMG's conducting rails) into more than one conducting part, the armature acts as both an armature and an electrical switch that commutes current from the different phases to the divided rails in the EMG, thereby eliminating or substantially reducing the size of the rectifying system used in present multi-phase EMGs. In EMGs whose output current is rectified, the rectifiers weigh as much or more than the rest of the machine and, consequently, limit the applications where the EMG is practicable. In addition, the divided rails of the present invention enable the self inductance of the rails to be lower than single-piece rails, thereby yielding improved EMG performance.

Figure 1:
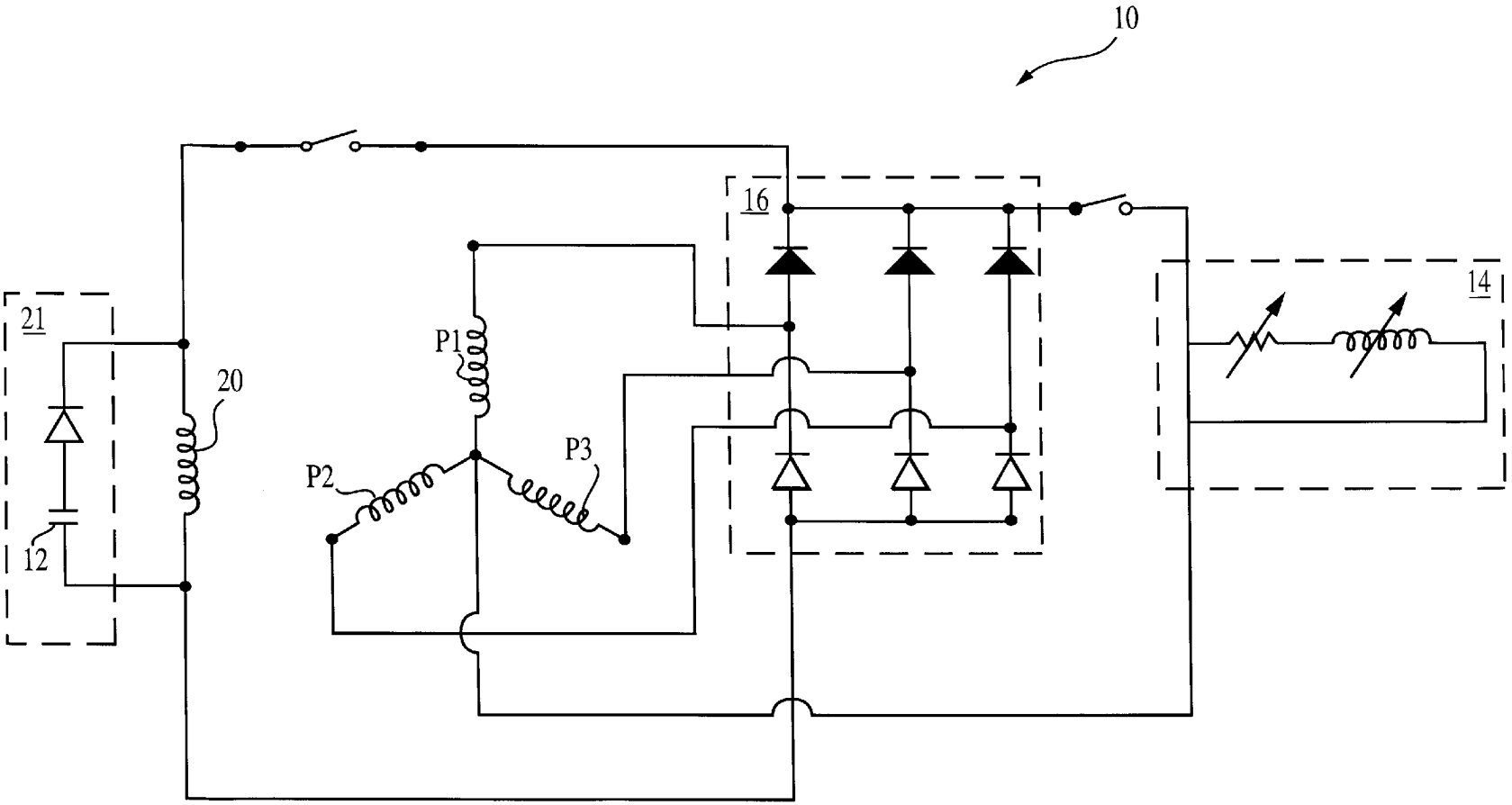
FIG. 1 PRIOR ART
FIG. 1 is a simplified wiring diagram of an EMG.
Figure 2:
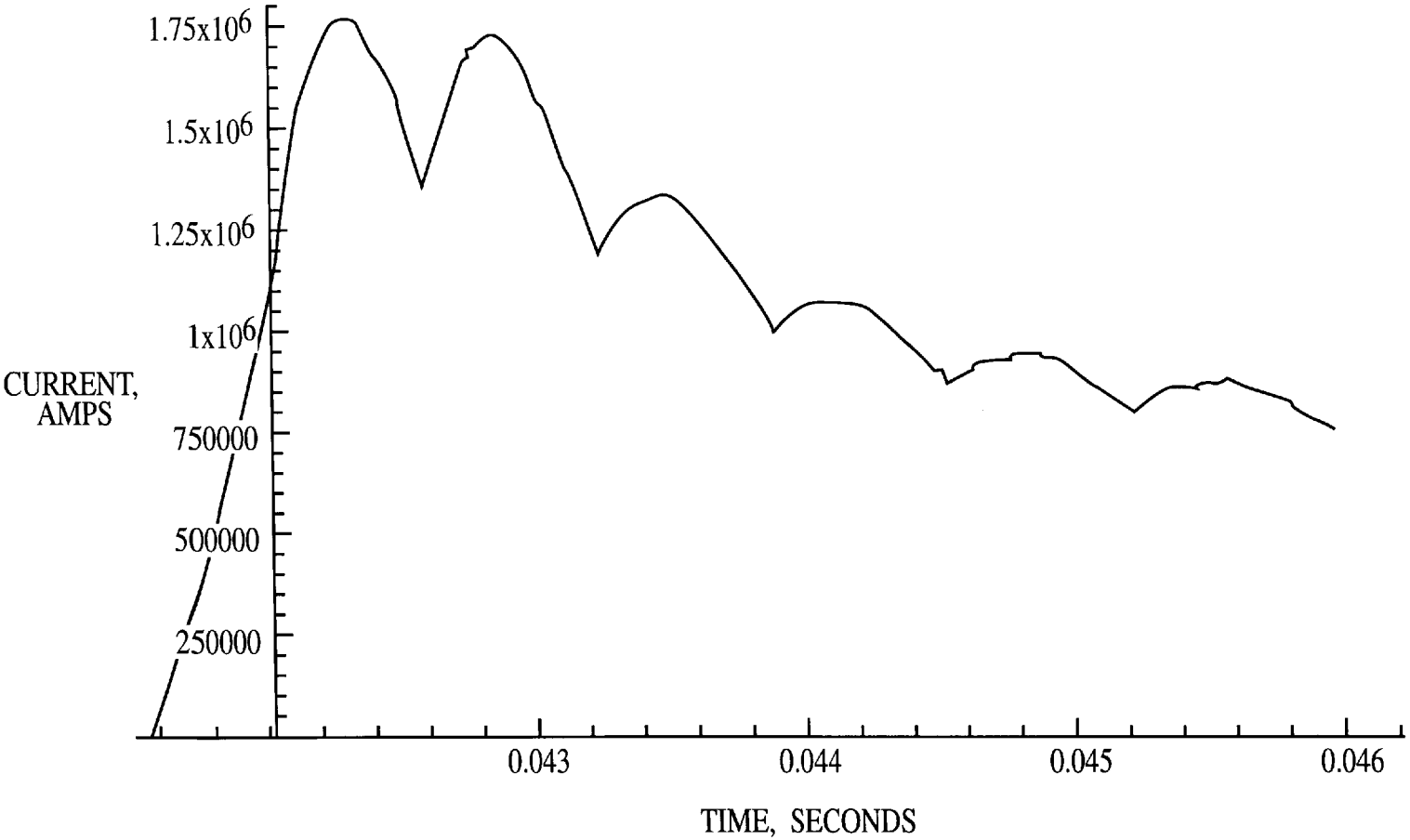
FIG. 2 is a graph of the typical, rectified current which flows through the rails of the EMG of FIG. 1 as a function of time.

The invention utilizes a multi-channel armature and multiple, short rails tailored to the pulse length from each electrical phase of the stator coils for operation of the EMG, thus obviating use of a rectifying system for the stator coil circuits and allowing more effective and efficient operation due to lower rail impedances in the pulse power system. By incorporating the invention into present day EMGs such as the one shown schematically in FIG. 1, a more efficient and lighter system can be built which may find greater application, such as use in a mobile system.

More particularly, the invention relates to a composite armature which comprises conducting and non-conducting parts. The composite armature commutes positive (and/or negative) electrical outputs from the different windings of the generator to different rails of the EMG as the armature exerts a force on a sabot and projectile in the EMG. The electrical signal in the rails of the EMG is much like that obtained presently by the use of rectifiers.

The different rails are separated electrically and correspond to distinguishable sets of rails for each electrical phase of the multi-phase generator. The length of each set of rails is determined self-consistently by solving the system of equations containing the circuit equations, for the position of the armature along the rails, the rotor position, and the current through the rails. By separating the rails in this manner, a lower self inductance is obtained, which leads to improved gun performance, while the inductive gradient along the rails remains constant as the armature accelerates.

Additionally, in the embodiments of the invention described below, the lengths of the rails may be adjusted to achieve the maximum, or a desired value, of the projectile's kinetic energy. The rail lengths may be chosen as fixed values determined by performance requirements or, alternatively, the rails may have field-adjustable lengths. For example, the operator of the EMG may adjust the rail lengths by adding or removing "building block" segments that make up each rail or adjusting the lengths of telescopic rails.

The manner in which the output power from the stator coils is modified and handled (as guided by the relation between the rotor and armature positions determined initially by the dynamical equations) is the basis of the present invention that allows improved EMGs to be made. In the invention, it is assumed that a portion of the power generated either in the stator coils or in an auxiliary coil is rectified and directed back through the field coil, yielding a constant polarity field coil current. It is further assumed that the rotor supporting the field coil is driven by an external means, for example, a diesel engine. The rotating magnetic field caused by the rotating field coil induces voltages in the stator coils which are wired to the rails.

In general, the invention is used in a multi-pole rotating source-based EMG. However, to clarify the description of the invention, the implementation of the invention will be described in the context of a single pole rotating machine where the relation between electric angle and mechanical angle of the rotor, for any given secondary phase, is 1:1. The generalization to multi-pole machines will be apparent to those of ordinary skill in the art.

Figure 4:
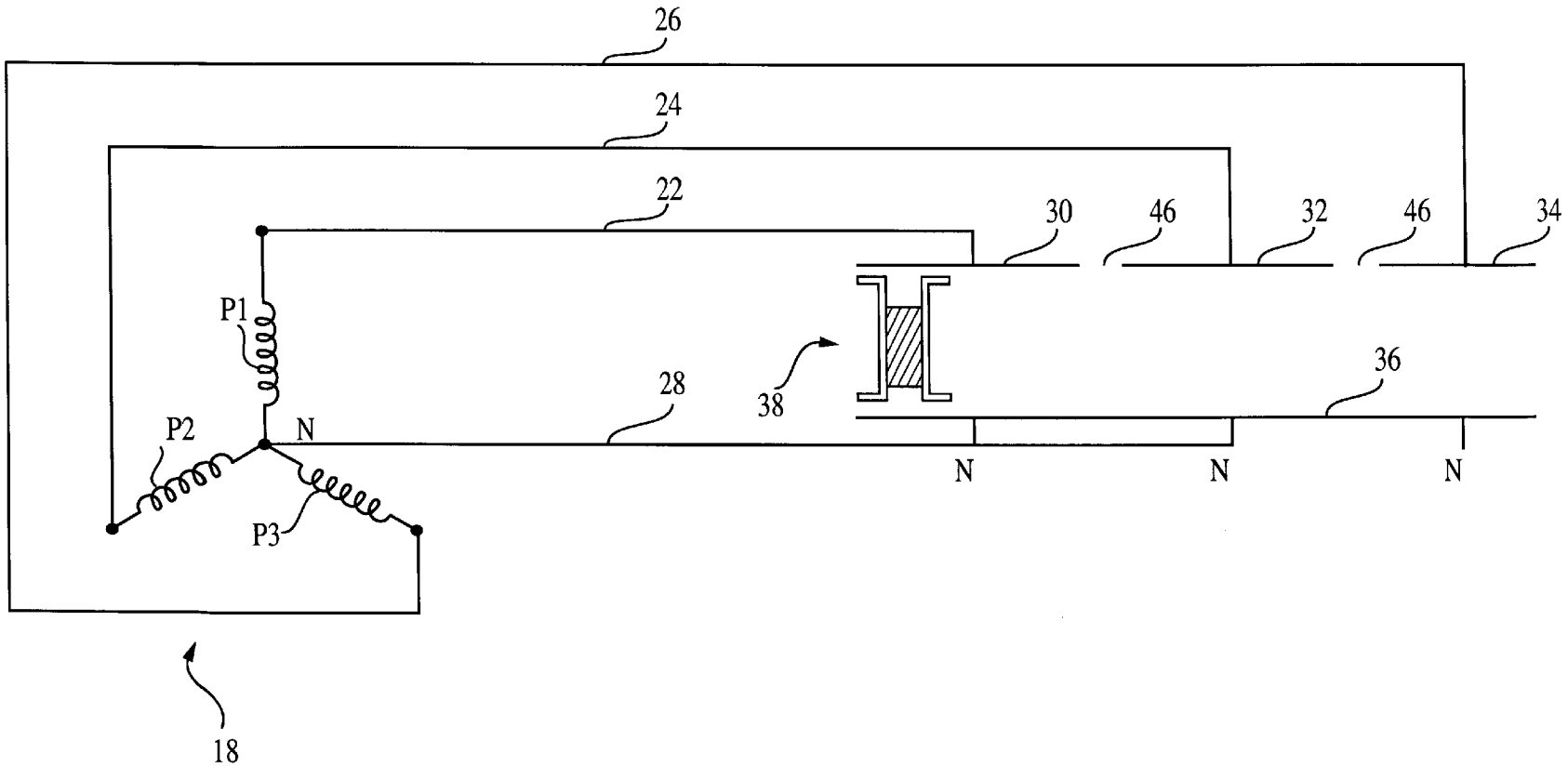
FIG. 4 is a schematic diagram of the first three sets of rails for a three-phase EMG, where, for simplification, the single pole rotating field coil is not shown and the armature is in its starting position.

To further simplify the discuss ion of the invention, we will first consider the embodiment of FIG. 4. FIG. 4 schematically shows a three-phase generator 18 with electrical leads 22, 24, 26 from the output ends of each phase P1, P2, P3 respectively, and from a common (neutral) lead 28 connecting all three phases P1, P2, P3 as at the center of a Y-connection. These leads 22, 24, 26, 28 are connected electrically to the P1, P2, P3 and neutral rails 30, 32, 34, 36, respectively. The armature 38 acts as a switch across the rails 30, 32, 34, 36 to complete the circuits causing current to flow in the rails, which exerts a force (directed along the rails) on the armature 38. The armature can have an initial velocity (supplied by a separate means) or begin at rest.

Figure 3:
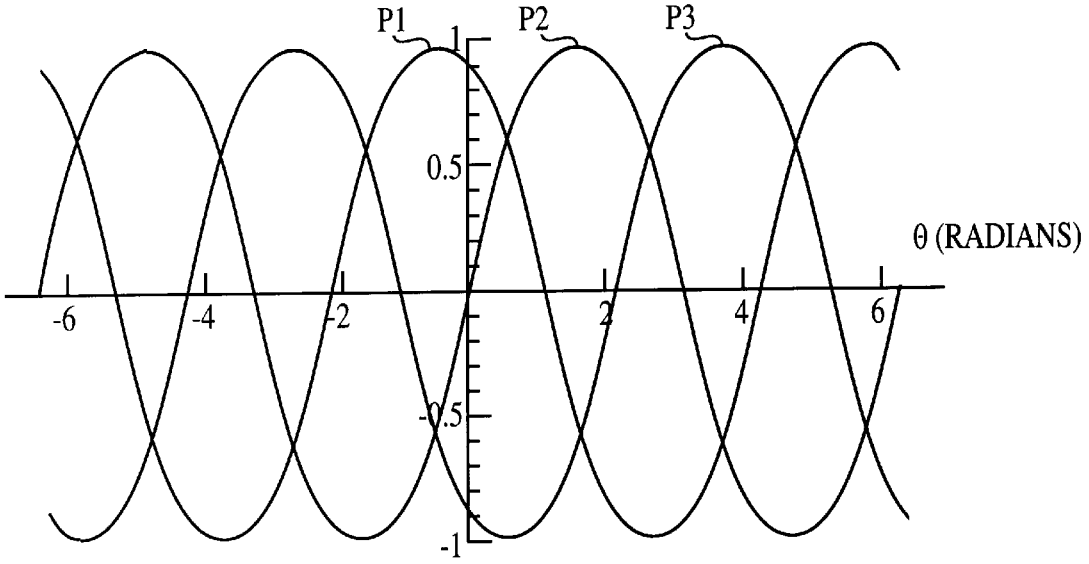
FIG. 3 is a graph of the voltages generated in the three (unloaded) stator coils of FIG. 1 as a function of electrical angle (corresponding to time), if the rotor is driven at constant speed.

As the single pole field coil (not shown) of the EMG of FIG. 4 rotates, voltages as shown in FIG. 3 are induced across the stator coils P1, P2, P3. A current exists in the first set of rails 30, 36 when the positive-polarity, phase 1 voltage is applied across the rails 30, 36 (the armature 38 is in its initial position) causing a force on the armature 38 which is directed along the rails. Because the armature 38 is free to slide along the rails, it will accelerate to the right as shown in FIG. 6.

Figure 5:
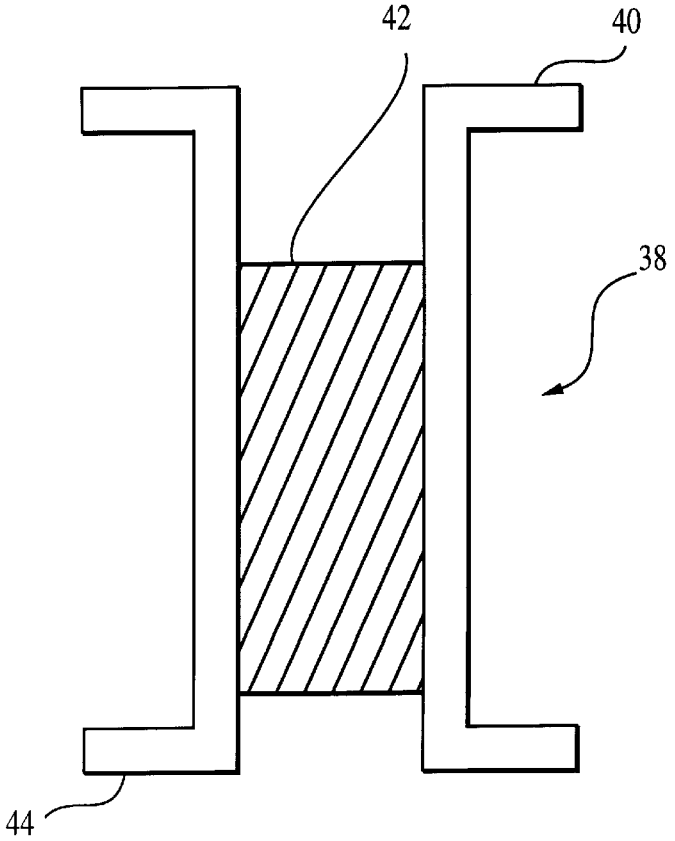
FIG. 5 schematically shows an armature for use with the EMG of FIG. 4.

FIG. 5 schematically shows an armature 38 for use with the EMG of FIG. 4. The armature 38 comprises at least two conducting plates made of, for example, copper. The front and rear conducting plates 40, 44 are separated by an insulating material 42. The insulating material 42 may be any suitable electrical insulator. The armature is constructed by, for example, glueing the conducting plates 40, 44 to the insulating material 42. The conducting plates 40, 44 function as two separate channels.

Figure 6:
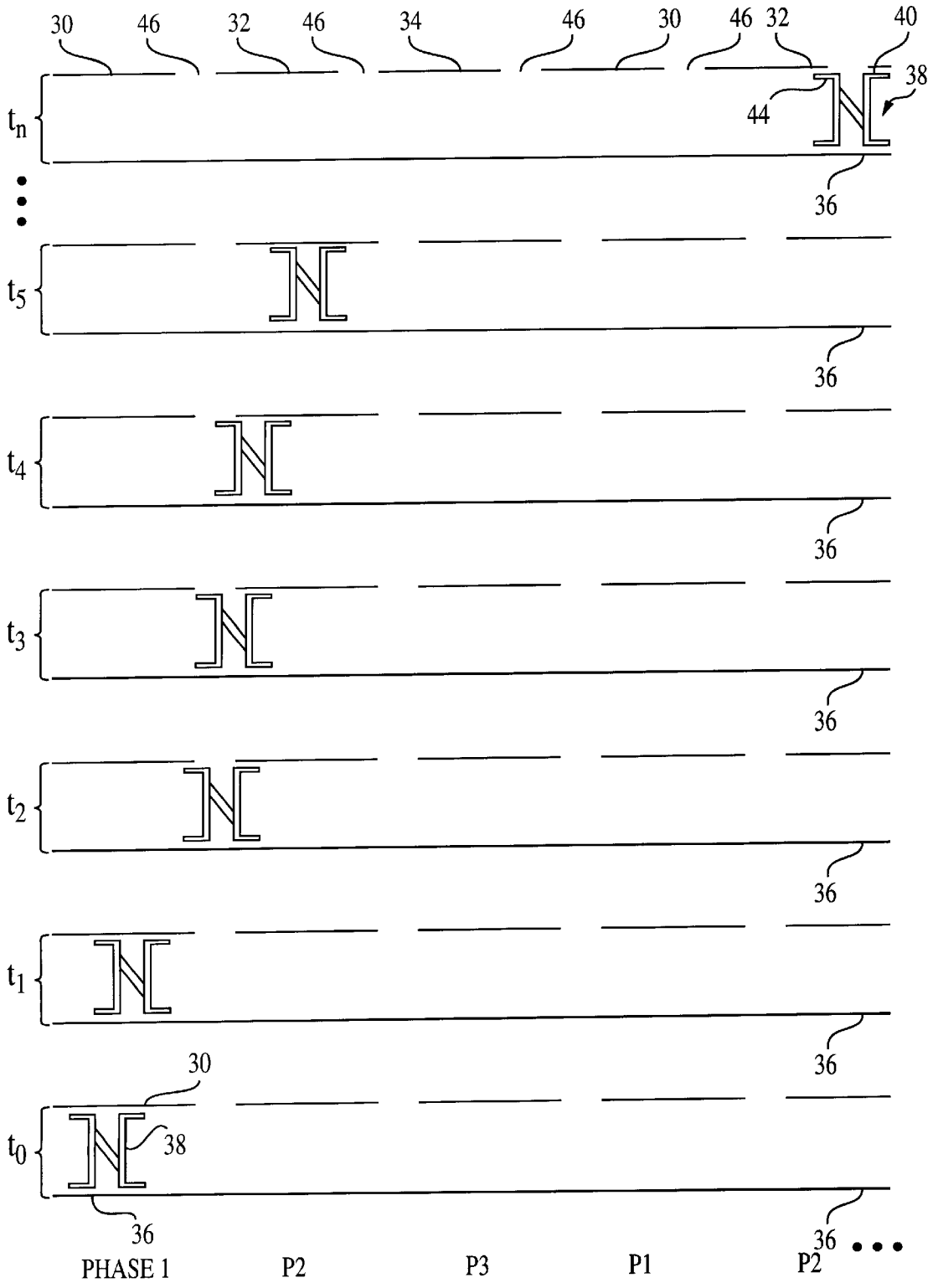
FIG. 6 shows different armature positions in the EMG of FIG. 4 along the rails whose lengths match one-half of an electrical period for each phase.

FIG. 6 shows a time sequence of movement of the armature 38. For each time t0–tn, the bottom rail is the neutral rail 36, which may be continuous or segmented. The top rails correspond to the P1, P2, P3 rails 30, 32, 34. The top rails 30, 32, 34 are separated by, for example, insulating gaps 46. At t0, the armature 38 is between the P1 rail 30 and the neutral rail 36. As the armature 38 moves to the right in FIG. 6, phase 1 (P1) current will flow through both the front and rear plates 40, 44 of the dual-channel armature 38. As the front plate 40 of the armature advances into the insulating gap 46 between the P1 and P2 rails 30, 32 at t2, only P1 current will flow in the rear plate 44 of the armature. Next, at t3, the front plate 40 will contact the P2 rail 32 and conduct P2 current while the rear plate is still conducting P1 current. At t4, The armature 38 will clear the first insulating region 46 between the first sets of rails 30, 36 (at the end of the positive part of the phase 1 pulse) but will remain in contact with the P2 rail 32 through the front plate 40. Finally, at t5, both plates 40, 44 of the armature 38 will conduct only phase 2 current. This process will be repeated as the armature 38 advances along the rails so that it is conducting only P3 current.

The sequence of events of FIG. 6 can be repeated for as many rail lengths and/or phases as desired. The rail lengths are tailored to match the length of the positive part of the pulse for a given phase. When the projectile (which is being accelerated along with its sabot by the armature 38) leaves the rail gun, the current in the last set of rails should be near a minimum so that energy lost by magnetic fields set up by electric currents is recoverable by conventional means (as via a high impedance load across the last set of rails). Total current in the armature 38 as it conducts current from phases 1, 2, and 3 is as shown in FIG. 7, where the solid line represents the total armature current for one pass through the rails per positive part of the electrical period for each phase vs. time (current flows through the armature only for positive polarity of each phase).

A second embodiment 50 of the invention is schematically shown in FIGS. 8 and 9. FIG. 8 is a view looking down the barrel of the EMG and FIG. 9 is a side view of the EMG barrel. The P1 rails 52 are rotated by 90 degrees from the P2 rails 54. As best seen in FIG. 9, the rails 52, 54 also overlap somewhat in the z-direction (the direction along the EMG barrel) so that the P2 current in rail 54 is conducted by the armature 56 (see FIG. 10) before it disconnects from the P1 rail 52 (and the P1 circuit breaks) stopping the P1 current through the other channel of the armature.

Figure 10:
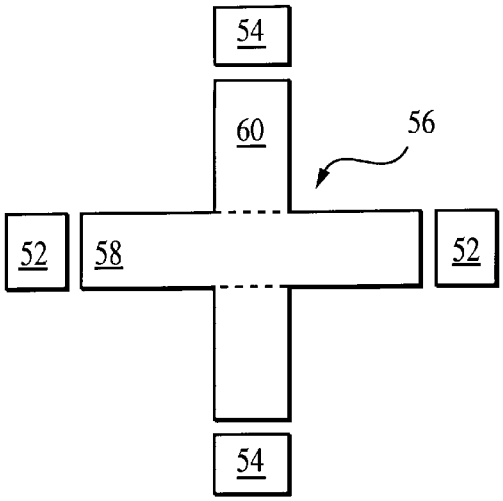
FIG. 10 is a schematic view of an armature for use with the embodiment of FIG. 8.

As shown in FIG. 10, the armature 56 is separated by insulating material into two parts allowing current to flow in the horizontal direction through one channel and in the vertical direction in the other channel. The horizontal channel is defined by a conducting plate 58 and the vertical channel is defined by a conducting plate 60. The conducting plates 58, 60 are insulated from each other.

As the armature 56 moves up along the P1 rails 52, current flows through the horizontally conducting plate 58 of the armature. When the armature initially makes contact with the P2 rails, P1 current continues to flow and P2 current begins to flow through the vertical plate 60 of the armature. As the armature continues moving down the EMG barrel, only P2 current flows in the vertical conducting channel 60. This process continues as the armature 56 encounters the P3 rails 62, which are in the same orientation as the first set of P1 rails 52. The resulting current would again be like that shown in FIG. 7, and the exit criterion would again be when current through the last rail is small enough to avoid arcing.

Figure 11:
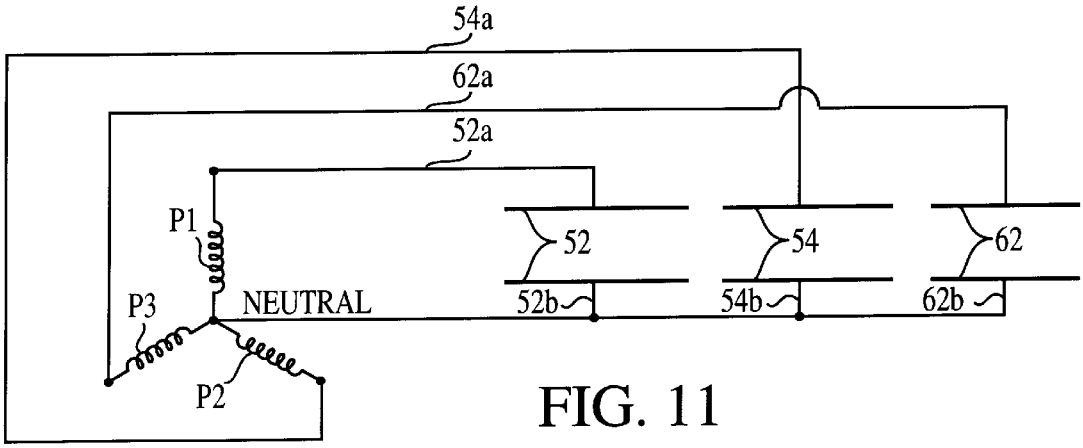
FIG. 11 is a simplified wiring diagram of the embodiment of FIG. 8.

FIG. 11 shows a simplified wiring diagram for the EMG of FIGS. 7 and 8. Electrical leads 52*a*, 52*b* connect the P1 coil rails 52. Electrical leads 54*a*, 54*b* connect the P2 coil to the rails 54. Electrical leads 62*a*, 62*b* connect the P3 coil to the rails 62. Additional coils (phases) could be provided and connected to additional rails in a similar manner.

Figure 12:
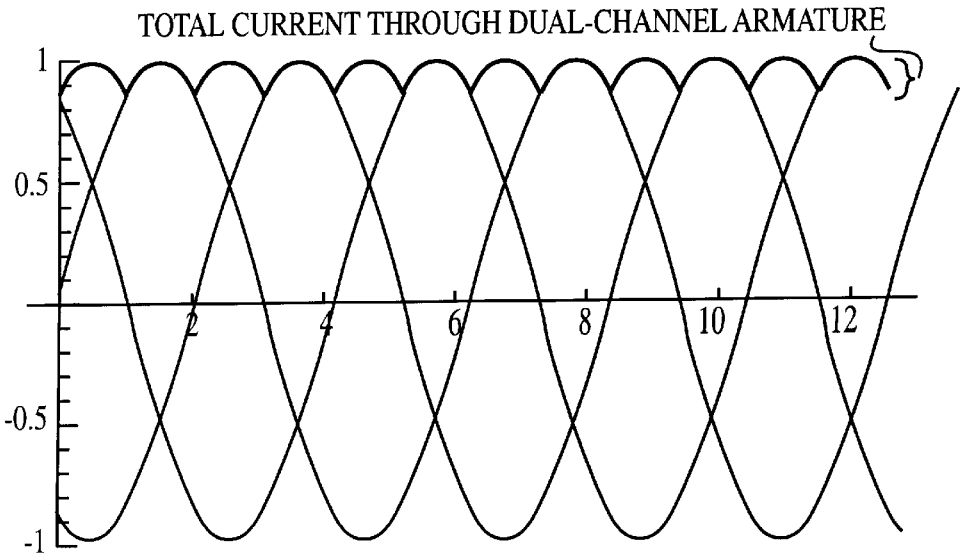
FIG. 12 represents the current through the armature of the EMG of FIG. 8. as three channels are made to conduct during one complete cycle through all electrical phases. The total current is given by the solid curve.

A third embodiment of the invention incorporates the principles of the first two described embodiments by utilizing a multi-channel armature while adding rails that lie in other than a single plane (or are staggered in the same plane), but in a way to make use of the negative amplitudes of each of the phases. For example, as the armature progresses along the rails, it contacts rails where the wires from each phase of the stator coils are reversed so that current still flows in the same direction through the armature for smooth acceleration of the armature. Continuous current flows in the armature via a second phase (and through a second channel of the armature) as the voltage through the first phase goes through zero. By incorporating additional rails in this manner, the use of the full electrical cycle of each pulse is used thereby yielding total current through the armature as shown in FIG. 12. As in the second embodiment, the individual sets of rails are displaced in the longitudinal direction of the EMG barrel. In this configuration, the EMG can be shortened for the same output velocity of a given projectile.

Figure 13:
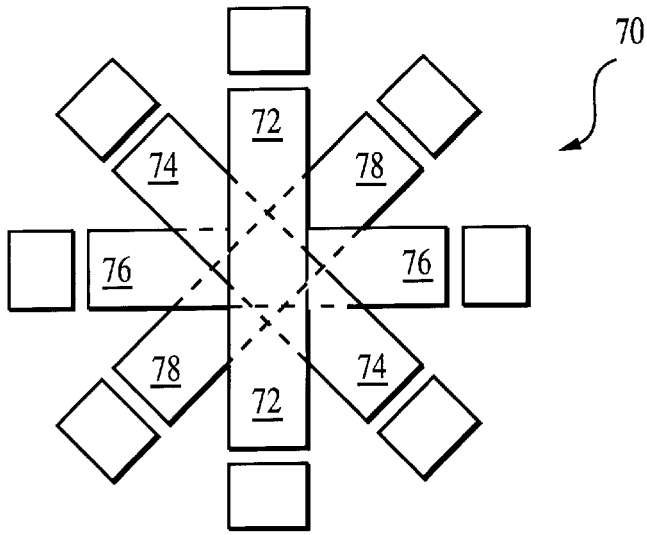
FIG. 13 is a schematic of an armature for use with a third embodiment of the invention.

FIG. 13 is a schematic of an armature 70 for use with a third embodiment of the invention. The armature 70 comprises four conducting plates 72, 74, 76, 78 wherein each plate is electrically insulated from the other. As shown in FIG. 13, if the first plate 72 is in a vertical position, the second plate 74 is rotated 45 degrees from the vertical, the third plate 76 is horizontal, and the fourth plate 78 is rotated 45 degrees from the third plate 76. The armature 70 uses both the positive and negative cycles of each electrical phase.

Figure 14:
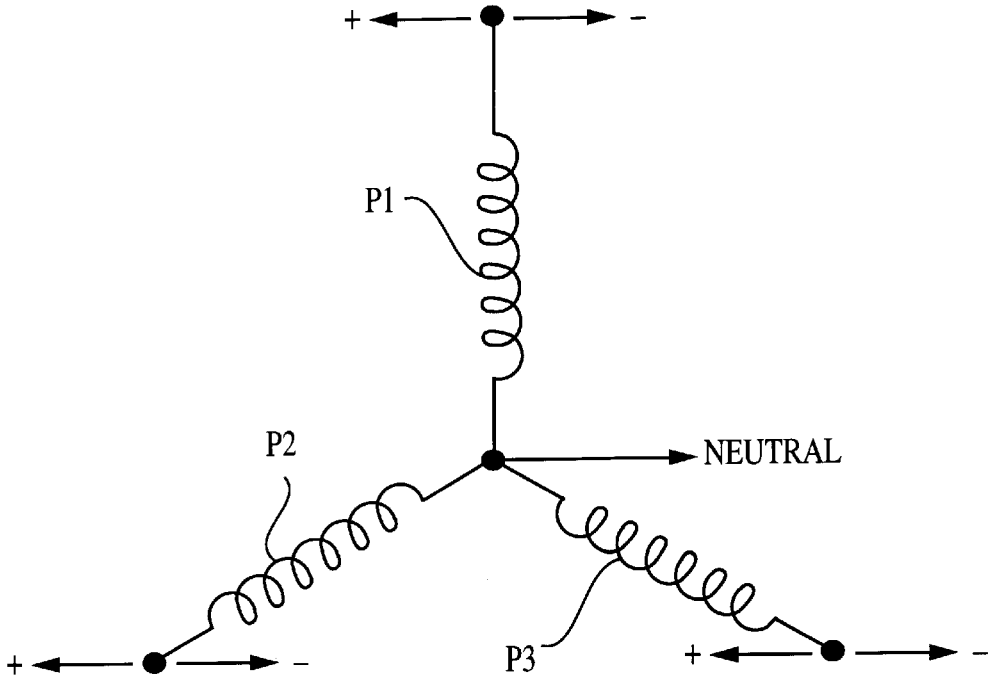
FIG. 14 is a simplified wiring diagram of the third embodiment of the invention.

FIG. 14 is a simplified wiring diagram of the third embodiment of an EMG according to the invention. In FIG. 14, the positive leads from each phase P1, P2, P3 are connected to rails which contact plates 72 and 76 of the armature 70. The negative leads from each phase P1, P2, P3 are connected to rails which contact plates 74 and 78 of the armature 70. The rails which contact plates 72 and 76 of the armature 70 are rotated 45 degrees from the rails which contact plates 74 and 78 of the armature 70. Each pair of rails is connected on one side to a positive or negative lead from one of the phases P1,P2 or P3 and on the other side to the neutral.

Table 1 below shows the connection points of the three phases P1, P2, P3 in the third embodiment of the invention. Rotor position is indicated by θ. The values in Table 1 are based on the assumption that P1 voltage=0 when θ=0.

TABLE 1

| | ROTOR POSITION (DEGREES) | | | | | | | | | | | | | |
|---|---|---|---|---|---|---|---|---|---|---|---|---|---|---|
| PHASE | 0 | 60 | 120 | 180 | 240 | 300 | 360 | 420 | 480 | 540 | 600 | 660 | 720 | 780 |
| P1+ | X | X | X | X | | | X | X | X | X | | | | |
| P1− | | | | X | X | X | X | | | X | X | X | X | |
| P2+ | | | X | X | X | X | | | X | X | X | X | | |
| P2− | | | | | | X | X | X | X | | | X | X | X |
| P3+ | | | | | X | X | X | X | | | X | X | X | X |
| P3− | | | | | | | | X | X | X | X | | | X |

Figure 15:
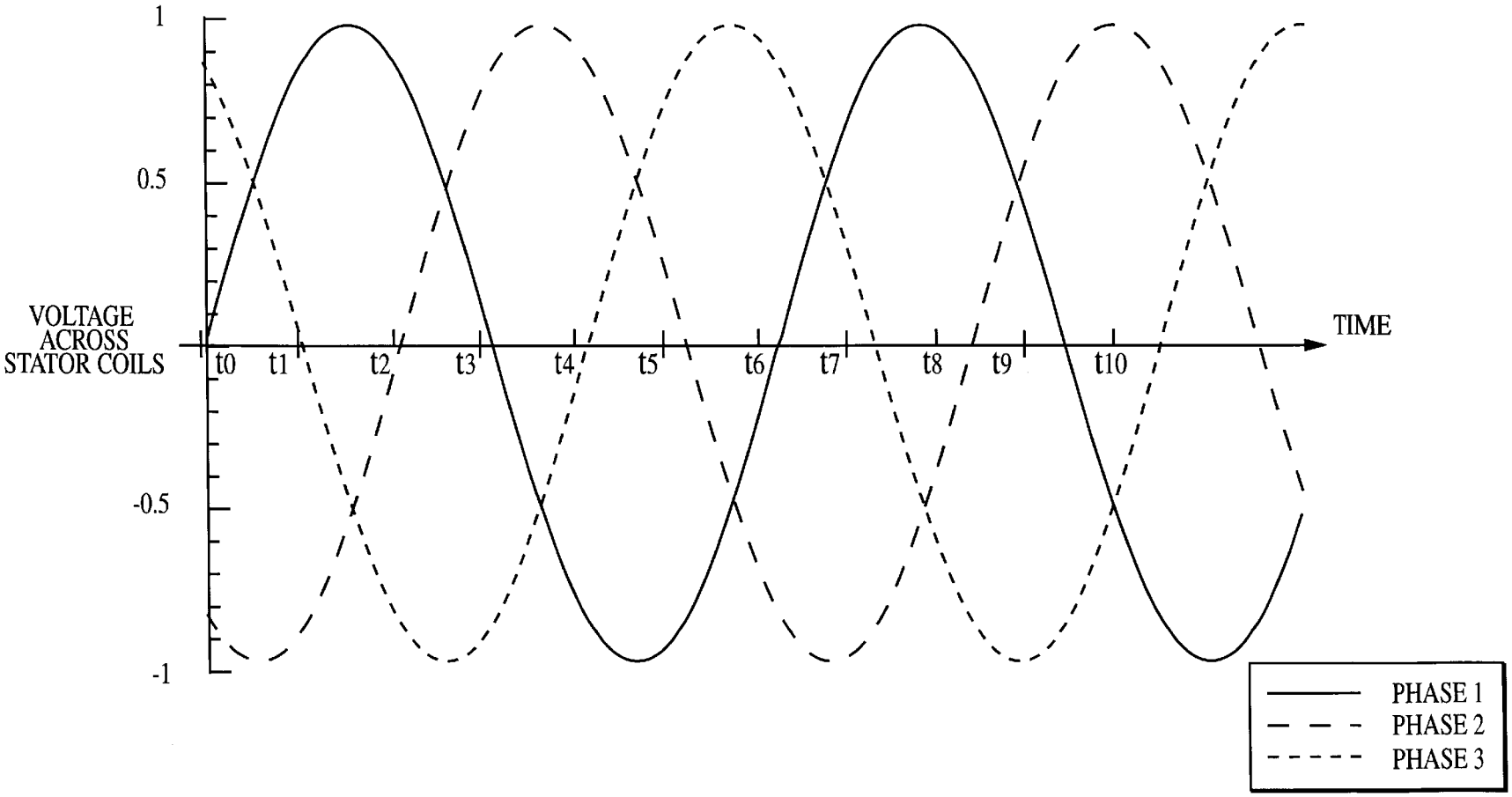
FIG. 15 shows the voltage across the stator coils as a function of time for the third embodiment.

FIG. 15 shows the voltage across the stator coils as a function of time for the three phases P1, P2, P3. Phase P1 is connected to plate 72 of armature 70 from t0 to t2 and to plate 74 from t2 to t5. Phase P2 is connected to plate 76 from t1 to t4 and to plate 78 from t4 to t7. Phase P3 is connected to plate 72 from t3 to t6 and to plate 74 from t6 to t8.

There are many other embodiments that can be devised by employing these basic principles when multi-polar/multi-phase generators are used for powering an EMG. The main principles are:

1) multi-channel armatures can be used for the switching of currents of multi-pole, multi-phase generators through rails;

2) the rails are tailored to match the armature's position along the rails with the appropriate polarity of a given phase to maximize the acceleration of the armature as it slides along the rails of an EMG, making it unnecessary to use rectifiers between the stator coil outputs and the rails.

While the invention has been described with reference to certain preferred embodiments, numerous modifications, changes and alterations to the described embodiments are possible without departing from the spirit and scope of the invention, as defined in the appended claims and equivalents thereof.

What is claimed is:

1. An electromagnetic launcher comprising:

a multi-phase electrical generator powered by an external source, the multi-phase electrical generator including at least one pole;

electrical conductors leading from output coils of the generator and from a center point joining the output coils;

a plurality of rails connected to the electrical conductors; and a split armature having at least two conductive channels separated by an insulative material;

whereby there is at least one position of the split armature along the plurality of rails where current flows simultaneously through both of the at least two channels.

2. The electromagnetic launcher of claim 1 wherein lengths of the plurality of rails are adjusted to maximize performance of the electromagnetic launcher.

3. The electromagnetic launcher of claim 1 wherein the generator is a synchronous, three-phase electrical generator and wherein the electrical conductors lead from three output coils of the generator and from the center point joining the three output coils.

4. The electromagnetic launcher of claim 3 further comprising means for recovering energy stored in magnetic fields set up by current flowing in the launcher as a projectile exits the electromagnetic launcher.

5. The electromagnetic launcher of claim 3, wherein lengths of the plurality of rails are determined by matching the armature's position along the rails with an angular position of a rotor of the electrical generator.

6. The electromagnetic launcher of claim 3 wherein the armature comprises four conducting plates separated by electrical insulating material such that each plate functions as a channel.

7. The electromagnetic launcher of claim 3 wherein the plurality of rails includes a phase 1 rail connected to phase 1 of the electrical generator followed by a phase 2 rail connected to phase 2 of the electrical generator and then a phase 3 rail connected to phase 3 of the electrical generator, and a neutral rail wherein the armature moves between the neutral rail and the other rails.

8. The electromagnetic launcher of claim 7 wherein the plurality of rails includes further sets of phase 1, phase 2 and phase 3 rails.

9. The electromagnetic launcher of claim 7 wherein the neutral rail is continuous for a length of the electromagnetic launcher.

10. The electromagnetic launcher of claim 9 wherein the phase 1, phase 2 and phase 3 rails are isolated from each other by electrical insulating material.

11. The electromagnetic launcher of claim 3 wherein the armature comprises two conducting plates separated by electrical insulating material such that one plate functions as a first channel and the other plate functions as a second channel.

12. The electromagnetic launcher of claim 11 wherein the conducting plates of the armature are essentially parallel to each other.

13. The electromagnetic launcher of claim 11 wherein the conducting plates of the armature are essentially perpendicular to each other.

14. The electromagnetic launcher of claim 13 wherein the plurality of rails comprises a first pair of rails disposed opposite each other, a second pair of rails disposed opposite each other and rotated about ninety degrees from the first pair of rails and a third set of rails disposed opposite each other and rotated about ninety degrees from the second pair of rails.

15. The electromagnetic launcher of claim 14, wherein each pair of rails is electrically insulated from adjacent rails.

16. The electromagnetic launcher of claim 14 wherein the first pair of rails is connected to phase 1 of the electrical generator, the second pair of rails is connected to phase 2 of the electrical generator and the third set of rails is connected to phase 3 of the electrical generator.

17. The electromagnetic launcher of claim 16 wherein the plurality of rails includes further pairs of phase 1, phase 2 and phase 3 rails.

18. The electromagnetic launcher of claim 16, wherein each pair of rails overlaps an adjacent pair of rails in a longitudinal direction.

* * * * *